US006047776A

United States Patent [19]

Kiang et al.

[11] Patent Number: 6,047,776

[45] Date of Patent: Apr. 11, 2000

[54] ENHANCED CONTROL LINE EXIT

[75] Inventors: Tan Hoon Kiang, Lorong J Telok Kurau, Singapore; C. Jean Brunjes, Missouri City, Tex.

[73] Assignee: ABB Vetco Gray Inc., Houston, Tex.

[21] Appl. No.: 09/007,377

[22] Filed: Jan. 15, 1998

[51] Int. Cl.[7] ..... E21B 33/03; E21B 33/04

[52] U.S. Cl. ..... 166/379; 166/65.1; 166/75.13; 166/75.14; 166/382

[58] Field of Search ..... 166/65.1, 75.13, 166/75.14, 77.1, 85.5, 241.5, 241.6, 241.7, 368, 379, 382

[56] References Cited

U.S. PATENT DOCUMENTS

| | | | |
|---|---|---|---|
| Re. 34,071 | 9/1992 | Van Bilderbeek | 166/342 |
| 4,600,054 | 7/1986 | Miller et al. | 166/75.14 X |
| 4,794,988 | 1/1989 | Van Bilderbeek | 166/345 |
| 4,938,289 | 7/1990 | Van Bilderbeek | 166/342 |
| 5,213,162 | 5/1993 | Iato | 166/65.1 X |
| 5,240,076 | 8/1993 | Cromar et al. | 166/208 X |
| 5,289,882 | 3/1994 | Moore | 166/65.1 X |
| 5,875,849 | 3/1999 | Martin et al. | 166/382 |

*Primary Examiner*—George Suchfield
*Attorney, Agent, or Firm*—James E. Bradley; Felsman Bradley Vaden Gunter & Dillon, LLP

[57] ABSTRACT

An angled passageway is provided in a tubing head of a wellhead assembly for reducing an angle of bend in a control line exiting from a tubing hanger. The angled passageway extends from the bottom to the top of the tubing hanger and is angled relative to the longitudinal axis. By traversing the longitudinal axis with the angled passageway, a sufficient angular orientation of the control line is achieved to minimize bend in the control tube. Another embodiment teaches an upper angled passageway segment in communication with a lower angled passageway segment that interface with one another at an angle. By providing two interacting angled passageways, the required angle of bend of the control tube exiting from the tubing hanger is further reduced.

16 Claims, 2 Drawing Sheets

ENHANCED CONTROL LINE EXIT

TECHNICAL FIELD

This invention relates in general to wellhead assemblies and in particular to an angled passageway in a tubing hanger for reducing an angle of bend in a control line exiting from a tubing hanger.

BACKGROUND ART

In oil and gas wells where the wellhead is located at surface level, a tubing hanger will land within a tubing head. The tubing hanger is located at the upper end of one or more strings of tubing through which production fluids will pass. A passageway is typically provided in a tubing hanger to accommodate a control line that may be provided for down hole equipment control.

In related art applications, a control line passageway is formed in a tubing hanger substantially parallel to the longitudinal axis of the tubing hanger. For small bore tubing heads this arrangement results in an undesirable sharp right angle bend of the control tubing.

SUMMARY OF THE INVENTION

A tubing hanger having an angled passage therein for receiving a control tube is provided. The angled passage reduces the radius of bend of the control tube exiting from an upper surface of the tubing hanger. To obtain the desired reduction in bend of the control tubing, the passageway through the tubing hanger extends from a first side of the longitudinal axis of the tubing hanger to a second side of the longitudinal axis.

In a second embodiment, the angled passageway has an upper segment and a lower segment, which intersect one another at an angle. The provision of a first and second section of an angled passageway further reduces the angle of bend of control tubing exiting from a tubing hanger. The reduction of angle of bend is particularly useful with very small tubing hangers.

DETAILED DESCRIPTION OF THE INVENTION

Figure 1:
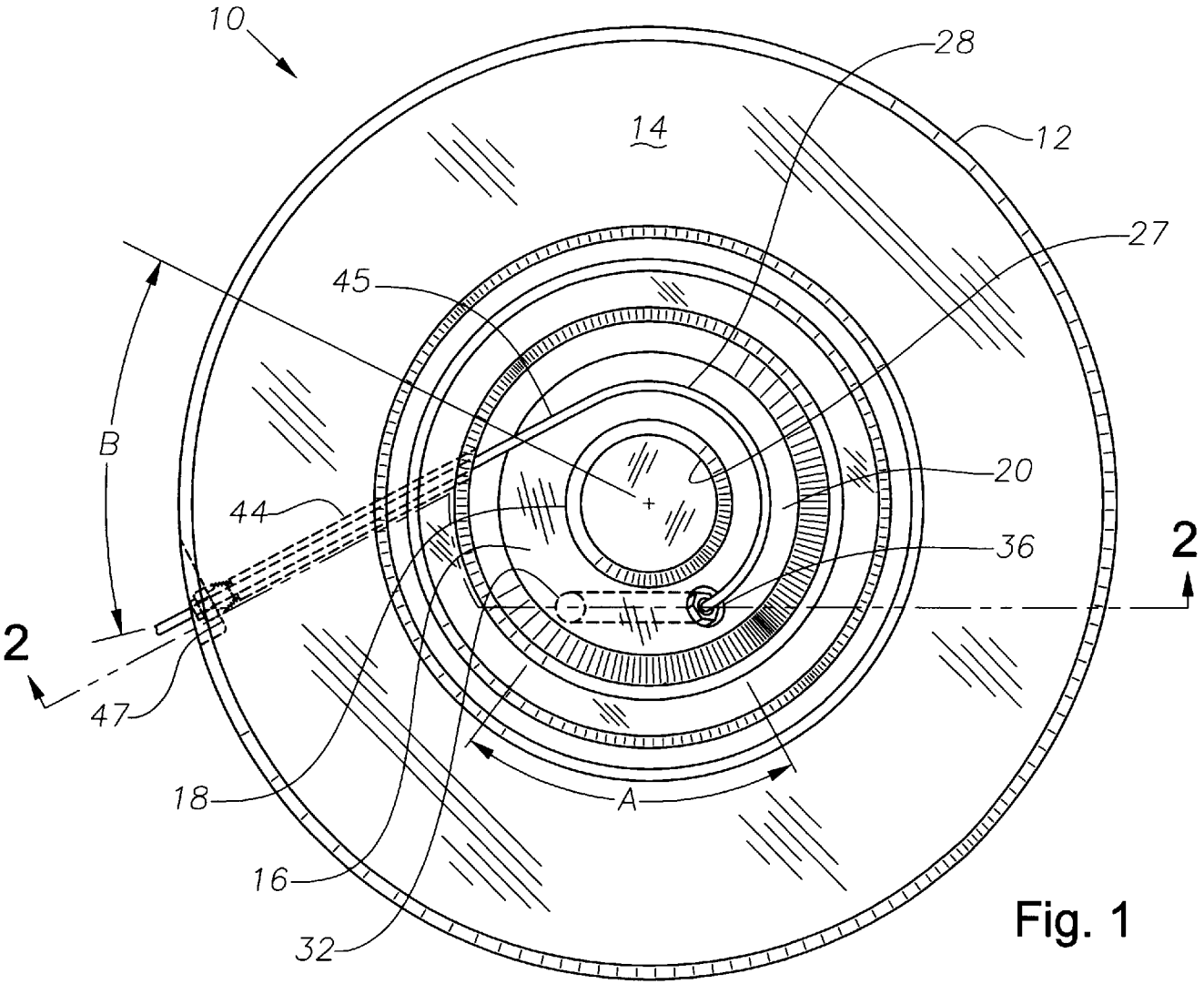
FIG. 1 is a top view of a tubing head and tubing hanger assembly having control tubing exiting from a tubing hanger and passing through the tubing head.
Figure 2:
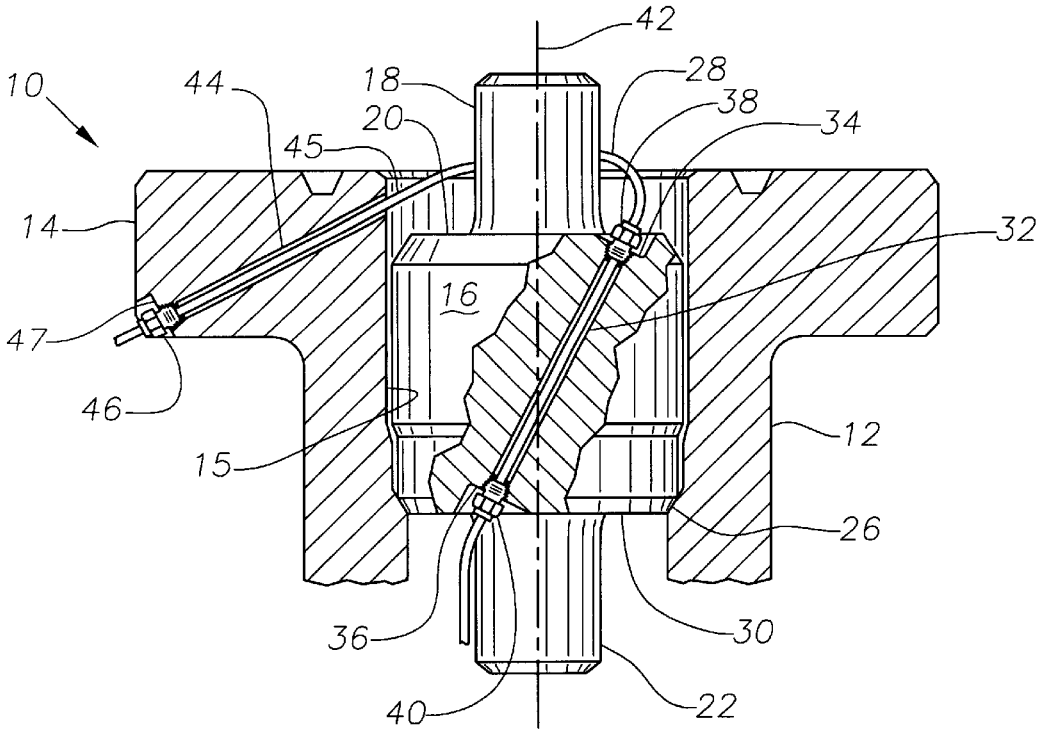
FIG. 2 is a sectional view of the tubing head and tubing hanger assembly taken along line 2—2 of FIG. 1.

Referring to FIGS. 1 and 2, a tubing head and hanger assembly is designated generally as 10. Tubing head 12 has an external tubing head flange 14 and axial bore 15. Tubing head 12 supports a tubing hanger 16 as can be seen more clearly in FIG. 2. In the embodiment shown, tubing hanger 16 has neck 18 extending upwardly from upper surface 20 of tubing hanger 16. A string of tubing 22 is secured and supported by tubing hanger 16. Tubing hanger 16 is landed in tubing head bore 15 of tubing head 12. In this embodiment, tubing head 12 is provided with a load-carrying shoulder 26 to support tubing hanger 16. Tubing hanger 16 also has an axial passage 27 (FIG. 1).

Exiting from tubing hanger 16 at a circumferential angle to upper surface 20 is control tube 28. Control tube 28 enters through bottom surface 30 of tubing hanger 16 proximate tubing string 22. Control tube 28 is preferably continuous and passes through an angled passageway 32 of tubing hanger 16. Angled passageway 32 has upper end 34 and lower end 36, and is provided for receiving control tube 28. Angled passageway 32 is angled in the preferred embodiment about 25 to 30 degrees relative to longitudinal axis 42 to provide a circumferential exit angle of control tube 28 for reducing the exit angle of bend of control tube 28. In the preferred embodiment, upper end 34 and lower end 36 of angled passageway 32 are the same radial distance from longitudinal axis 42 as shown in FIG. 1. A sufficient incline is present to reduce the angle of bend of control tube 28. Passageway lower end 36 is spaced circumferentially from upper end 34 by an angle A that is about 60 degrees in the embodiment shown. Passageway 32 does not intersect axial passage 27.

Control tube 28 is affixed to tubing hanger 16 by upper fitting 38 and lower fitting 40. Preferably, upper fitting 38 and lower fitting 40 are threaded into upper end 34 and lower end 36 of passageway 32. Upper end 34 and lower end 36 of passageway 32 are spaced circumferentially from one another. Preferably, passageway 32 is oriented such that upper end 34 and lower end 36 are substantially at the same radial distance from the longitudinal axis. Control tube 28 exits from upper surface 20 of tubing hanger 16 at a circumferential angle and bends around neck 18 for passing through a tubing head passage 44.

Tubing head passage 44 is formed in tubing head flange 14 of tubing head 12. Tubing head passage 44 has an inner end 45 at bore 24 and an outer end 47 at a lower exterior corner of flange 14. Inner end 45 is spaced circumferentially from outer end 47 by an angle B, which is 40 degrees in the embodiment shown. Furthermore, passageway 44 is angled downward, with outer end 47 being lower than inner end 45. In a preferred embodiment, tubing head passage 44 is formed in tubing head flange 14 at an angle of approximately 67 degrees with respect to axis 42. Passageway 44 does not exit at an angle normal to the exterior of flange 14, rather it exits at an angle of about 65 degrees relative to the cylindrical exterior of flange 14.

In operation, control tubing 28 is inserted in lower end 36 of angled passageway 32 and exits from upper end 34 of angled passageway 32. Control tube 28 is bent one or more rounds around neck 18 and inserted in tubing head passage 44. Control tube 28 is secured to tubing hanger 16 by upper fitting 38, which is threaded into tubing hanger 16 and lower fitting 40, which is also threaded into tubing hanger 16. Additionally, tubing head fitting 46 is provided to secure control tube 28 to tubing head 12. An upper tubular member (not shown) will be mounted on top of tubing head 12.

Figure 3:
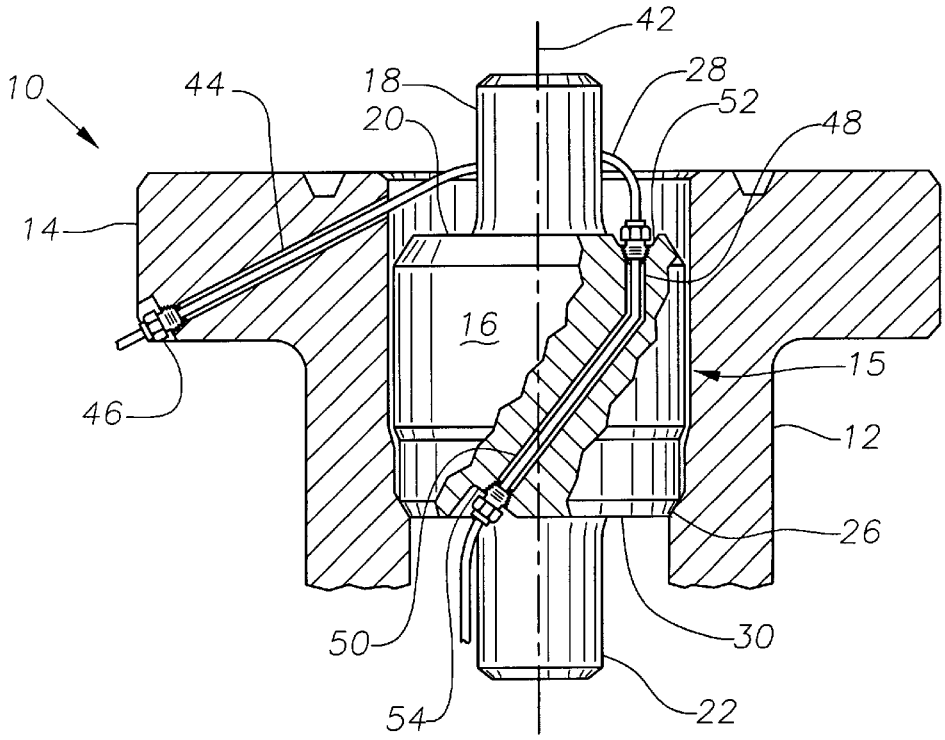
FIG. 3 is a partial sectional view of the tubing head and tubing hanger assembly wherein an angled passageway is comprised of an upper and lower section.

In an alternate embodiment of the invention, angled passageway 32 is formed with a straight upper segment 48 and a straight lower segment 50 as shown in FIG. 3. Upper segment 48 has upper end 52 at upper surface 20 of tubing hanger 16. Lower segment 50 has lower end 54 at bottom surface 30 of tubing hanger 16. As in the first embodiment, upper end 52 and lower end 54 are circumferentially spaced from each other. Upper segment 48 and lower segment 50 are not in the same plane. In a preferred embodiment, upper segment 48 and lower segment 50 join each other at a 135 degree angle. Preferably, upper segment 48 and lower segment 50 incline to opposite sides of neck 18. However, upper segment 48 may be angled and lower segment 50 may be straight or other configurations may be possible. By providing a separate upper segment 48 and lower segment 50 and a circumferential exit angle of control tube 28, the exit angle of control tube 28 may be further reduced. A reduction in exit angle eliminates sharp bends in control tube 28. As shown in FIG. 3, upper segment 48 is angled away from the viewer so that the circumferential exit angle of control tube 28 is less than 90 degrees with upper surface 20 of tubing hanger 16.

The invention has significant advantages. By utilizing angled passageway 32 of the invention, a sharp bend in control tube 28 is not necessary to run control tube 28 through tubing head passageway 44 in tubing head flange 14. The invention is particularly useful with tubing heads of small diameter.

While the invention has been shown in only two of its forms, it should be apparent to those skilled in the art that it is not so limited, but is susceptible to various changes without departing from the scope of the invention.

I claim:

1. A wellhead assembly, comprising:

a tubing head having a bore having a longitudinal axis;

a tubing hanger having a top and a bottom; and a tubing hanger passageway for receiving a control line, said tubing hanger passageway having an upper end at said top of said tubing hanger and a lower end at said bottom of said tubing hanger, said upper end and said lower end being spaced circumferentially from each other.

2. The wellhead assembly according to claim 1, wherein said upper end and said lower end are substantially at the same radial distance from said longitudinal axis.

3. A wellhead assembly according to claim 1, wherein:

said tubing head has an external flange; and said wellhead assembly further comprises a tubing head passageway for receiving a continuation of said control line, said tubing head passageway extending from said interior bore outward through said flange.

4. A wellhead assembly according to claim 1 wherein:

said tubing head has an external flange; and said wellhead assembly further comprises a tubing head passageway for receiving a continuation of said control line, said tubing head passageway extending from said interior bore outward and downward through said flange and exiting on a lower side of said flange.

5. A wellhead assembly according to claim 1 wherein said tubing hanger passageway has an upper segment and a lower segment that form an angle relative to each other.

6. A wellhead assembly according to claim 1 wherein said tubing hanger passageway is straight.

7. A wellhead assembly according to claim 1, wherein said passageway is comprised of:

a straight upper segment extending downward from said upper end partially through said tubing hanger; and a straight lower segment extending upward from said lower end and joining said upper segment wherein said upper segment and said lower segment are inclined relative to each other at an obtuse angle.

8. A wellhead assembly according to claim 1, wherein:

said tubing head has an external flange; and said wellhead assembly further comprises a tubing head passageway for receiving a continuation of said control line, said tubing head passageway having an inner end and an outer end spaced circumferentially.

9. A wellhead assembly according to claim 1, wherein said passageway is comprised of:

an upper segment extending downward from said upper end partially through said tubing hanger; and a lower segment extending upward from said lower end and joining said upper segment, wherein a junction of said upper segment with said lower segment is spaced circumferentially between said upper end and said lower end of said tubing hanger passageway.

10. A wellhead assembly, comprising:

a tubing head having a bore, an external flange, and a tubing head passageway extending from said bore outward through said flange;

a tubing hanger having a top and a bottom;

an angled tubing hanger passageway extending through said tubing hanger, said angled tubing hanger passageway having an upper end at said top of said tubing hanger and a lower end at said bottom of said tubing hanger, said upper end and said lower end being spaced circumferentially from each other; and an angled tubing head passageway extending from said bore through said tubing head, said angled tubing head passageway having an inner end at the bore and an outer end at an exterior portion of said tubing head.

11. A wellhead assembly according to claim 10, wherein said tubing head passageway inner and outer ends are spaced circumferentially from each other.

12. A wellhead assembly according to claim 10, wherein said tubing hanger passageway upper end and said lower end are at substantially the same radial distance from a longitudinal axis of said bore.

13. A wellhead assembly according to claim 10, wherein said tubing hanger passageway is comprised of:

an upper angled segment extending downward from said upper end partially through said tubing hanger; and a lower segment extending upward from said lower end and joining said upper segment wherein said upper segment and said lower segment are inclined relative to each other.

14. A wellhead assembly according to claim 10, wherein said outer end of said tubing head passageway is lower that said inner end of said tubing head passageway, said tubing head passageway extending through said flange.

15. A method of installing a control line in a wellhead comprising:

providing a tubing head having a bore;

providing a tubing hanger having a control line passageway wherein an upper end of said passageway and a lower end of said passageway are spaced circumferentially from each other;

landing said tubing hanger in said bore of said tubing head;

inserting a control line in said passageway in said tubing hanger; and securing said control line to said tubing hanger with at least one fitting.

16. A method of installing a control line in a wellhead according to claim 15 further comprising:

providing an angled tubing head passageway;

bending an upper portion of said control line above said tubing head; and inserting said control line through said tubing head passageway.

* * * * *